US010145185B2

(12) United States Patent
Nguyen

(10) Patent No.: US 10,145,185 B2
(45) Date of Patent: Dec. 4, 2018

(54) WEAR BUSHING RETRIEVAL TOOL

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 297 days.

(21) Appl. No.: 14/983,209

(22) Filed: Dec. 29, 2015

(65) Prior Publication Data

US 2017/0183922 A1 Jun. 29, 2017

(51) Int. Cl.

| | |
|---|---|
| ***E21B 17/12*** | (2006.01) |
| ***E21B 33/03*** | (2006.01) |
| *E21B 19/00* | (2006.01) |
| *E21B 33/04* | (2006.01) |
| *E21B 33/06* | (2006.01) |

(52) U.S. Cl.

CPC ..... *E21B 17/12* (2013.01); *E21B 33/03* (2013.01); *E21B 19/00* (2013.01); *E21B 33/04* (2013.01); *E21B 33/06* (2013.01)

(58) Field of Classification Search

CPC ..... E21B 17/12; E21B 17/1007; E21B 33/03
See application file for complete search history.

(56) References Cited

U.S. PATENT DOCUMENTS 3,350,130 A * 10/1967 Ahlstone ..... E21B 7/12 166/240
3,473,608 A * 10/1969 Castille ..... E21B 17/1007 166/212
3,489,214 A * 1/1970 Crain ..... E21B 17/10 166/85.3
4,109,728 A * 8/1978 Sanford ..... E21B 17/1007 166/217
4,361,353 A * 11/1982 Vinson ..... E21B 17/1007 166/181
4,362,210 A * 12/1982 Green ..... E21B 33/04 166/82.1
4,625,381 A * 12/1986 Gravouia, Jr. ..... E21B 17/1007 166/85.3
4,995,458 A * 2/1991 Garbett ..... E21B 17/1007 166/85.3

(Continued)

FOREIGN PATENT DOCUMENTS

GB 1060968 A 8/1967
WO 2010057221 A2 5/2010

OTHER PUBLICATIONS

PCT International Search Report & Written Opinion for PCT Application No. PCT/US2016/067882 dated Mar. 9, 2017; 14 Pages.

*Primary Examiner* — Matthew R Buck
(74) *Attorney, Agent, or Firm* — Fletcher Yoder, P.C.

(57) ABSTRACT

A system includes a wear bushing retrieval tool. The wear bushing retrieval tool includes a main body, a plurality of apertures extending from an inner diameter of the annular main body to an outer diameter of the annular main body, a plurality of fasteners, wherein each of the plurality of fasteners is disposed within a respective one of the plurality of apertures, and a plurality of pins extending from the outer diameter of the annular main body, wherein the annular main body is configured to be disposed about a tubular string being run into a wellhead, and wherein the plurality of pins is configured to engage with a wear bushing disposed within the wellhead.

20 Claims, 7 Drawing Sheets

(56) References Cited

U.S. PATENT DOCUMENTS

| | | | | | |
|---|---|---|---|---|---|
| 5,044,438 | A * | 9/1991 | Young | E21B 17/1007 | 166/382 |
| 6,003,602 | A * | 12/1999 | Wilkins | E21B 33/035 | 166/339 |
| 7,284,616 | B2 * | 10/2007 | Williams | E21B 17/1007 | 166/381 |
| 8,322,441 | B2 * | 12/2012 | Fenton | E21B 17/1007 | 166/339 |
| 8,727,012 | B2 * | 5/2014 | Bhat | E21B 33/035 | 166/338 |
| 9,540,888 | B2 * | 1/2017 | Reimert | E21B 17/1007 | |

* cited by examiner

WEAR BUSHING RETRIEVAL TOOL

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as various control lines, casings, valves, and the like, that control drilling and/or extraction operations.

In drilling and extraction operations, various components and tools, in addition to and including wellheads, are employed to provide for drilling, completion, and production of a mineral resource. For example, a long pipe, such as a casing, may be lowered into the earth to enable access to the natural resource. Additional pipes and/or tubes may then be run through the casing to facilitate extraction of the resource. Unfortunately, running of long pipe, such as casing, through the wellhead assembly can potentially cause premature wear and/or degradation to one or more wellhead assembly components from unintended or undesired contact between the pipe and the wellhead assembly.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed toward a wear bushing retrieval tool for use in retrieving a wear bushing installed in a wellhead assembly. More particularly, present embodiments include a wear bushing retrieval tool that may be installed over a tubular string being run into a wellbore through the wellhead assembly. As discussed in detail below, it may be desirable to install a wear bushing within a wellhead assembly prior to running a tubular string (e.g., casing string or tubing string) through the wellhead assembly into a wellbore in order to protect components (e.g., a spool bore) of the wellhead assembly from undesired or unintended contact with the tubular string as the tubular string is run into the wellbore. As the tubular string running operation nears completion, the wear bushing retrieval tool may be run into the wellhead assembly with the tubular string. In the manner described below, the tubular string may be used to enable landing of the wear bushing retrieval tool against the wear bushing within the wellhead assembly. Thereafter, the wear bushing retrieval tool may be used to retrieve the wear bushing from the wellhead assembly as or once the tubular running operation is completed.

Figure 1:
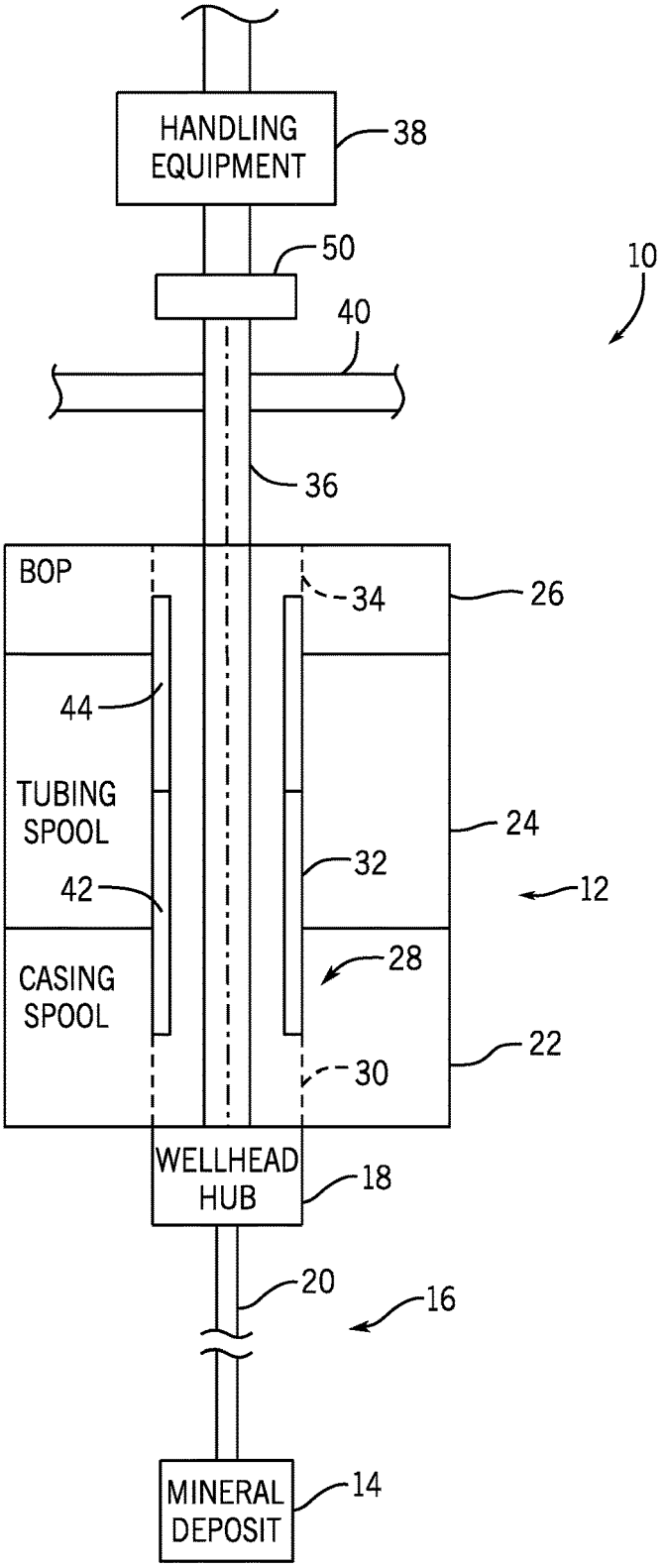
FIG. 1 is a schematic of a mineral extraction system including a wear bushing retrieval tool, in accordance with an embodiment of the present disclosure.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead 12 (e.g., a wellhead assembly) coupled to a mineral deposit 14 via a well 16. The well 16 may include a wellhead hub 18 and a wellbore 20. The wellhead hub 18 generally includes a large diameter hub disposed at the termination of the wellbore 20. Thus, the wellhead hub 18 may provide for the connection of the wellhead 12 to the well 16. The wellhead 12 may be coupled to a connector of the wellhead hub 18, for instance. Accordingly, the wellhead 12 may include a complementary connector, such as a collet connector.

The wellhead 12 generally includes a series of devices and components that control and regulate activities and conditions associated with the well 16. For example, the wellhead 12 may provide for routing the flow of produced minerals from the mineral deposit 14 and the wellbore 20, provide for regulating pressure in the well 16, and provide for the injection of chemicals into the wellbore 20 (down hole). In the illustrated embodiment, the wellhead 12 includes a casing spool 22 (e.g., tubular), a tubing spool 24 (e.g., a tubular) and a blowout preventer (BOP) 26 (e.g., a tubing hanger or a casing hanger). In operation, the wellhead 12 enables completion and workover procedures, such as the insertion of tools into the well 16 and the injection of various chemicals into the well 16. Further, minerals extracted from the well 16 (e.g., oil and/or natural gas) may be regulated and routed via the wellhead 12. For example, the BOP 26 may include a variety of valves, fittings, and controls to block oil, gas, or other fluid from exiting the well 16 in the event of an unintentional release of pressure or an overpressure condition.

As illustrated, the wellhead 12 defines a wellhead bore 28 (e.g., a spool bore) that enables fluid communication between the wellhead 12 and the well 16. Specifically, the casing spool 22 defines a casing spool bore 30, the tubing spool 24 defines a tubing spool bore 32, and the BOP 26 defines a BOP bore 34. The casing spool bore 30, the tubing spool bore 32, and the BOP bore 34 cooperatively and at least partially define the wellhead bore 28. Thus, the casing spool 22, the tubing spool 24, and/or the BOP 26 provide access to the wellbore 20 for various completion and workover procedures.

After a drilling operation is competed to at least partially create the wellbore 20, a tubular string 36 may be run into the wellbore 20 through the wellhead 12. For example, handling equipment (e.g., tubular handling equipment) 38 at a rig floor 40 of the mineral extraction system 10 may be used to assemble lengths of tubular (e.g., tubing or casing) to form the tubular string 36, and the handling equipment 38 may be used to run tubular string 36 into the wellhead 12 and the wellbore 20. During or after the drilling and/or tubular string 36 running process, the tubular string 36 may be cemented into the wellbore 20. As will be appreciated, the tubular string 36 may serve to isolate and/or protect formations adjacent to the wellbore 20 and/or block collapse of the wellbore 20.

As the tubular string 36 is run through the wellhead 12, components of the wellhead 12 (e.g., the casing spool 22, the tubing spool 24, etc.) may be exposed to contact with the tubular string 36. To block undesired contact between the components of the wellhead 12 and the tubular string 36 as the tubular string 36 is run through the wellhead 12 and into the wellbore 20, one or more sleeves, bushings, or other components may be positioned within the wellhead 12 to protect components of the wellhead 12 from undesired contact with the tubular string 36. For example, in the illustrated embodiment, the wellhead 12 includes a packoff bushing 42 disposed within the casing spool 22 and the tubing spool 24. The packoff bushing 42 may protect the casing spool bore 30 and/or the tubing spool bore 32 from contact with the tubular string 36 as the tubular string 36 is run into the wellbore 20 through the wellhead 12. Similarly, a wear bushing 44 is disposed within the tubing spool 24 and the BOP 26. Thus, the wear bushing 44 may protect the tubing spool bore 32 and/or the BOP bore 34 from contact with the tubular string 36 as the tubular string 36 is run into the wellbore 20 through the wellhead 12.

When the tubular string 36 running process is completed or near completion, it may be desirable to retrieve the wear bushing 44 from the wellhead 12. Accordingly, present embodiments include a wear bushing retrieval tool 50 for retrieving the wear bushing 44 from the wellhead 12. More specifically, the wear bushing retrieval tool 50 is configured to couple to the tubular string 36 (e.g., be disposed about and/or over the tubular string 36) as the final portion of the tubular string 36 is run through the wellhead 12. Thus, the tubular string 36 is used to run the wear bushing retrieval tool 50 into the wellhead 12. For example, the wear bushing retrieval tool 50 may be disposed about and coupled to the tubular string 36 at the rig floor 40 before a final portion of the tubular string 36 is run into the wellbore 20 through the wellhead 12. In the manner described in detail below, the wear bushing retrieval tool 50 may be landed against the wear bushing 44 within the wellhead 12 and subsequently decoupled from the tubular string 36 being run into the wellhead 12. Thereafter, the wear bushing retrieval tool 50 may be retrieved from the wellhead 12 along with the wear bushing 44 coupled to the wear bushing retrieval tool 50.

Although the disclosed embodiments describe the wear bushing retrieval tool 50 in the context of retrieving the wear bushing 44 from the tubing spool 24 and BOP 26, present embodiments may be used to retrieve bushings and/or sleeves from other wellhead 12 components, such as the casing spool 22, a multi-bowl system, or other tubular of the wellhead 12 that may support and retain a bushing or sleeve.

Figure 2:
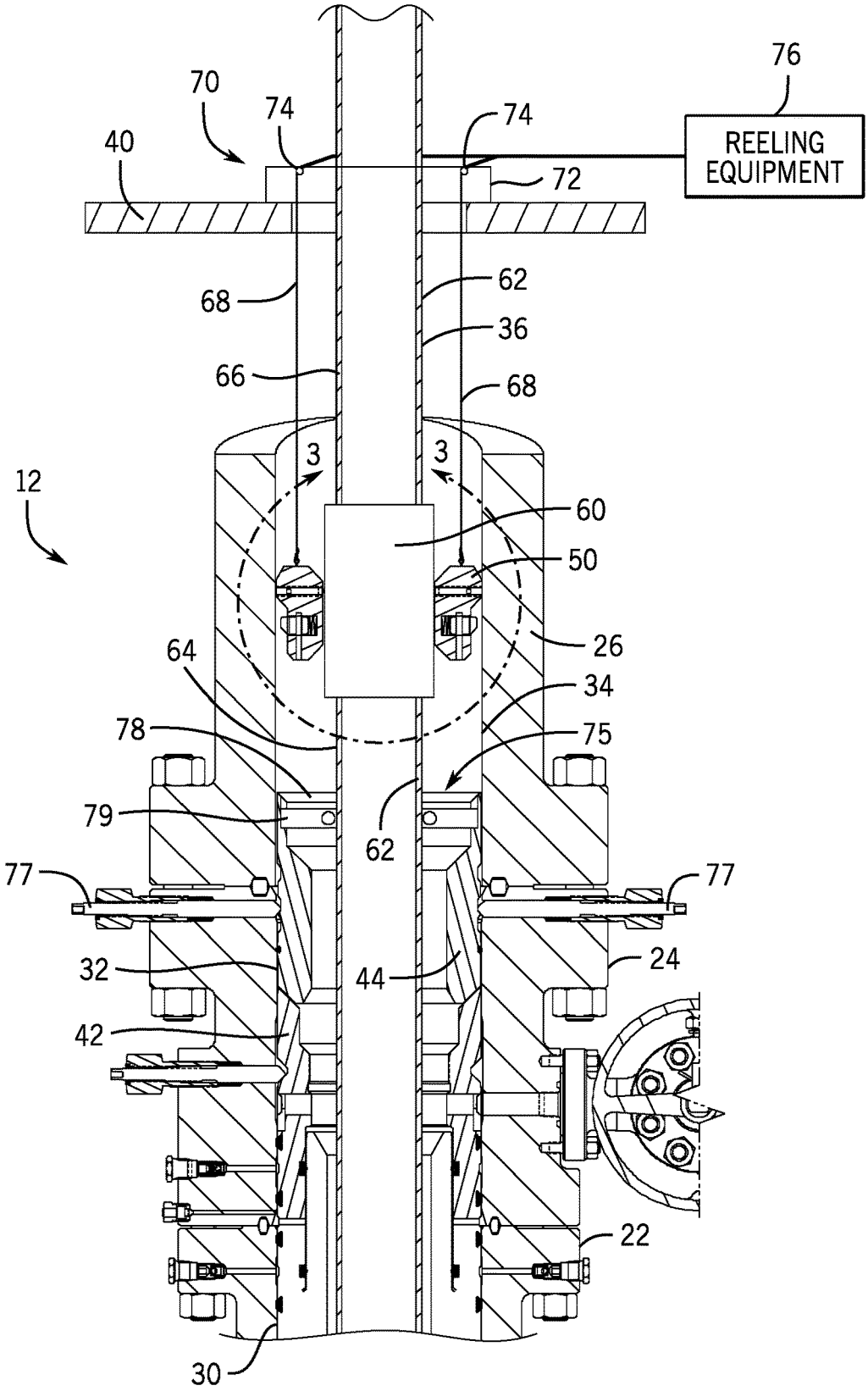
FIG. 2 is a cross-sectional side view of a wellhead assembly including a wear bushing retrieval tool disposed over a tubular string, in accordance with an embodiment of the present disclosure.

FIG. 2 is a cross-sectional side view of the wellhead 12, illustrating the wear bushing retrieval tool 50 coupled to the tubular string 36 as the tubular string 36 is run into the wellhead 12. As mentioned above, when the tubular string 36 running process nears completion, the wear bushing retrieval tool 50 may be coupled to the tubular string 36, and the tubular string 36 may be used to run the wear bushing retrieval tool 50 into the wellhead 12 for retrieval of the wear bushing 44.

In the illustrated embodiment, the wear bushing retrieval tool 50 is coupled to a collar 60 of the tubular string 36. As mentioned above, the tubular string 36 is formed with multiple sections 62 of tubular, which may be coupled to one another, e.g., via collars 60. The wear bushing retrieval tool 50 is coupled to the collar 60 to enable running of the wear bushing retrieval tool 50 into the wellhead 12 with the tubular string 36. In the manner described below, the wear bushing retrieval tool 50 may decouple from the collar 60 after the wear bushing retrieval tool 50 is landed against the wear bushing 44 and as the tubular string 36 continues to be run into the wellbore 20.

The wear bushing retrieval tool 50 may be coupled to the collar 60 at the rig floor 40. For example, in one embodiment, the collar 60 may first be coupled to a first section of tubular 64 that is part of the tubular string 36, and then the wear bushing retrieval tool 50 may be coupled to the collar 60. Thereafter, a second section of tubular 66 may be coupled to the collar 60, and the tubular string 36 may continue to be run into the wellhead 12 and wellbore 20, e.g., via the handling equipment 38. In this manner, the wear bushing retrieval tool 50 is disposed about, around, and/or over the tubular string 36. However, other orders of assembly and coupling the wear bushing retrieval tool 50 the tubular string 36 may be used.

As illustrated, one or more cables 68 are coupled to the wear bushing retrieval tool 50. The cables 68 remain attached to the wear bushing retrieval tool 50 as the wear bushing retrieval tool 50 is run into the wellhead 12 with the tubular string 36. The cables 68 are used to retrieve the wear bushing retrieval tool 50 and the wear bushing 44 after the wear bushing retrieval tool 50 is coupled to the wear bushing 44 in the wellhead 12. Specifically, the cables 68 run from the wear bushing retrieval tool 50 to a roller assembly 70 at the rig floor 40. For example, the roller assembly 70 may include a ring 72 (e.g., an annular ring or a split ring), rollers/pulleys 74, bearings, and/or any other components to enable retention and hoisting of the wear bushing retrieval tool 50 and wear bushing 44 via the cables 68. To this end, the mineral extraction system 10 also includes reeling equipment 76 to enable hoisting of the wear bushing retrieval tool 50 and the wear bushing 44 from the wellhead 12. For example, the reeling equipment 76 may include one or more motors, winches, reels, cranks, or other components to enable reeling of the cables 68. In certain embodiments, the reeling equipment 76 may enable automated hoisting of the wear bushing retrieval tool 50 and wear bushing 44 (e.g., via an automatic winch), manual hoisting of the wear bushing retrieval tool 50 and wear bushing (e.g., via a manual crank), or both.

As shown in the illustrated embodiment, the wear bushing 44 is retained within the wellhead 12 by lock screws or pins 77 (e.g., a retention feature) that extend radially through the tubing spool 24 to engage with the wear bushing 44. Additionally, the wear bushing 44 includes several features that will be referred to below. For example, the wear bushing 44 includes a chamfered surface 78 at an axial top 75 of the wear bushing 44. The wear bushing 44 also includes an annular recess 79, which is axially below the chamfered surface 78. As described below, the wear bushing retrieval tool 50 may engage with the chamfered surface 78 of the wear bushing 44 as the wear bushing retrieval tool 50 is run into the wellhead 12, and the wear bushing retrieval tool 50 may engage with the annular recess 79 of the wear bushing 44 when the wear bushing retrieval tool 50 is landed against the wear bushing 44 to enable retrieval of the wear bushing 44.

Figure 3:
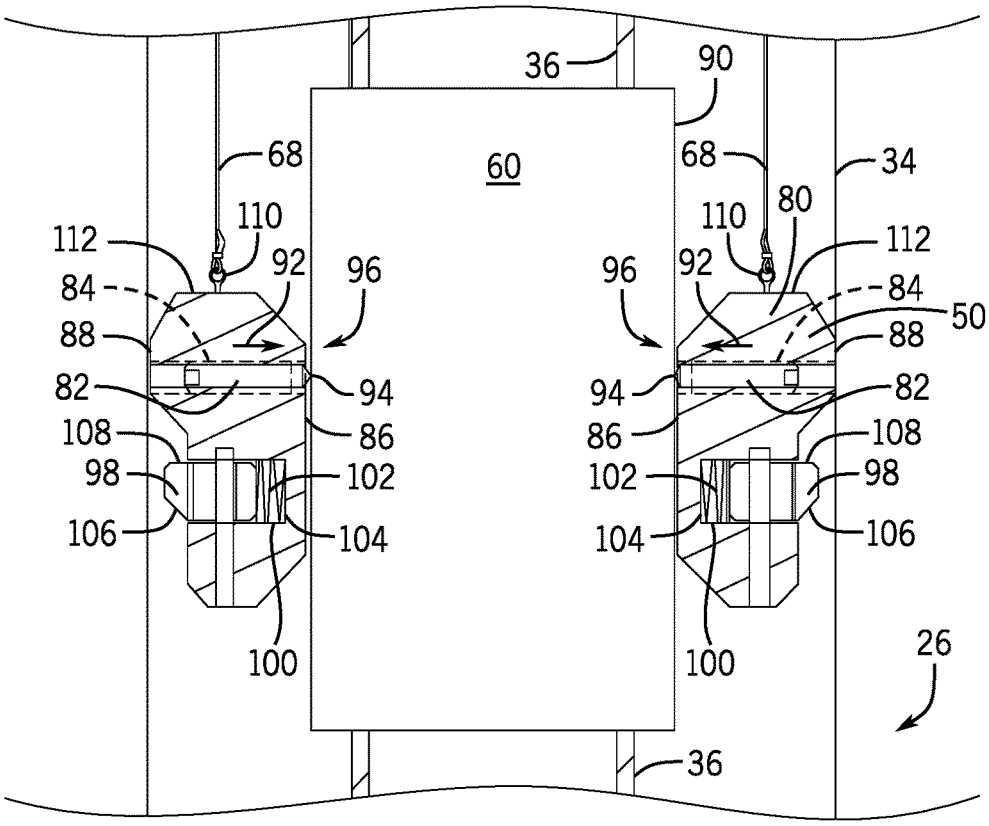
FIG. 3 is a cross-sectional side view, taken within line 3-3 of FIG. 2, of a wear bushing retrieval tool coupled to a tubular string, in accordance with an embodiment of the present disclosure.

FIG. 3 is a cross-sectional side view, taken within line 3-3 of FIG. 2, of an embodiment of the wear bushing retrieval tool 50 coupled to the collar 60, as the tubular string 36 is used to run the wear bushing retrieval tool 50 into the wellhead 12. While the illustrated embodiment shows the wear bushing retrieval tool 50 coupled to the collar 60, in other embodiments the wear bushing retrieval tool 50 may be coupled to other components of the tubular string 36 (e.g., one of the sections 62 of tubular). The wear bushing retrieval tool 50 includes a main body 80 that is disposed about the collar 60. For example, the main body 80 may be a generally annular body, such as a split ring. In other words, the main body 80 may have multiple sections that are coupled or fastened to one another to form the generally annular body disposed about the collar 60. As such, the main body 80 may have an inner diameter (e.g., inner diameter 86) that is similar in size or slightly larger than an outer diameter (e.g., outer diameter 90) of the collar 60. The main body 80 of the wear bushing retrieval tool 50 includes additional components, which are described in further detail below.

The wear bushing retrieval tool 50 is coupled to the collar 60 via a friction, compression, and/or interference fit. To this end, the wear bushing retrieval tool 50 includes a plurality of fasteners 82. Each of the fasteners 82 is disposed in a respective aperture 84 that extends radially from the inner diameter 86 of the main body 80 to the outer diameter 88 of the main body 80. The fasteners 82 may be bolts (e.g., threaded bolts), screws, pins, or other mechanical fasteners. For example, each of the fasteners 82 may threadingly engage with the respective aperture 84 in which the fastener 82 is disposed. Thus, each fastener 82 may be rotated to drive the fastener 82 radially inward to contact the outer diameter 90 of the collar 60, as indicated by arrows 92. In certain embodiments, each fastener 82 may have an edge or point 94 at a radially inward end 96 of the respective fastener 82 to enable and/or improve frictional engagement between the fastener 82 and the collar 60. As the fasteners 82 are driven radially inward to frictionally engage with the outer diameter 90 of the collar 60, the wear bushing retrieval tool 50 may be coupled to the collar 60 and thus the tubular string 36. However, the frictional coupling of the wear bushing retrieval tool 50 to the collar 60 is not a permanent coupling or attachment. As discussed below, the frictional coupling of the wear bushing retrieval tool 50 to the collar 60 enables decoupling of the collar 60 and tubular string 36 from the wear bushing retrieval tool 50 after the wear bushing retrieval tool 50 is landed against the wear bushing 44 within the wellhead 12.

The wear bushing retrieval tool 50 also includes features to enable coupling of the wear bushing retrieval tool 50 to the wear bushing 44 and retrieval of the wear bushing 44 with the wear bushing retrieval tool 50 from the wellhead 12. Specifically, the main body 80 of the wear bushing retrieval tool 50 houses and supports a plurality of pins 98, which extend radially outward from the outer diameter 88 of the main body 80. Each pin 98 is disposed within a respective pocket 100 formed in the main body 80 of the wear bushing retrieval tool 50. As described below, the pins 98 are configured to radially and axially engage with the annular recess 79 (shown in FIG. 2) of the wear bushing 44 when the wear bushing retrieval tool 50 is landed against the wear bushing 44. Thus, the pins 98 enable retrieval of the wear bushing 44 from the wellhead 12 with the wear bushing retrieval tool 50. The wear bushing retrieval tool 50 may include any suitable number of pins 98, such as 2, 3, 4, 5, 6, 7, 8, 9, 10, or more pins 98. In certain embodiments, the pins 98 may be spaced generally equidistantly about a circumference of the main body 80 of the wear bushing retrieval tool 50.

As illustrated, the pins 98 are spring-loaded within the respective pocket 100 housing each pin 98. To this end, a respective spring 102 is disposed between each pin 98 and a radially inward surface 104 of the respective pocket 100 housing each pin 98. In the illustrated embodiment, the pins 98 and springs 102 are shown in an equilibrium state (e.g., when a component external to the wear bushing retrieval tool 50 is not acting on the pins 98). That is, in the equilibrium state, the pins 98 extend at least partially radially outward from the outer diameter 88 of the main body 80.

The spring-loaded configuration of the pins 98 enables the pins 98 to retract within the pockets 100 if the pins 98 contact an intervening surface within the wellhead 12 and subsequently extend back out after contact is suspended. For example, when the wear bushing retrieval tool 50 is run into the wellhead 12 with the tubular string 36, the pins 98 may contact the chamfered surface 78 of the wear bushing 44 that is axially above the annular recess 79 of the wear bushing 44. Upon such contact, the pins 98 may be driven radially inward within the pockets 100 (e.g., by the chamfered surface 78) to enable further downward travel of the wear bushing retrieval tool 50 within the wellhead 12. To further enable radial retraction of the pins 98 within the pockets 100, each pin 98 includes a chamfered surface 106 (e.g., a downwardly facing chamfered surface) configured to contact the chamfered surface 78 of the wear bushing 44. The chamfered surfaces 106 of the pins 98 and the chamfered surface 78 of the wear bushing 44 engage and slide along one another to force the pins 98 radially inward into the pockets 100.

After the wear bushing retrieval tool 50 travels past the chamfered surface 78 of the wear bushing 44, the pins 98 become radially aligned with the annular recess 79 of the wear bushing 44 that is located axially below the chamfered surface 78 of the wear bushing 44. Thus, the springs 102 may force the pins 98 radially outward from the pockets 100 to the equilibrium state shown in FIG. 3. As the pins 98 are forced radially outward by the springs 102, the pins 98 may radially overlap with the annular recess 79 of the wear bushing 44. For example, a respective top surface 108 of each pin 98 may axially engage with a surface (e.g., surface 101 shown in FIG. 4) of the annular recess 79. The engagement between the pins 98 and the annular recess 79 enable retrieval of the wear bushing 44 from the wellhead 12, in the manner described below.

As mentioned above, cables 68 are connected to the wear bushing retrieval tool 50 as the wear bushing retrieval tool 50 is run into the wellhead 12. In the illustrated embodiment, the cables 68 are attached to the wear bushing retrieval tool 50 via eye hooks 110 coupled to an axially top surface 112 of the main body 80 of the wear bushing retrieval tool 50. However, in other embodiments, the cables 68 may be coupled to the main body 80 of the wear bushing retrieval tool 50 in other manners, such as via hooks, loops, bars, or other components that may or may not be integral with the main body 80.

Figure 4:
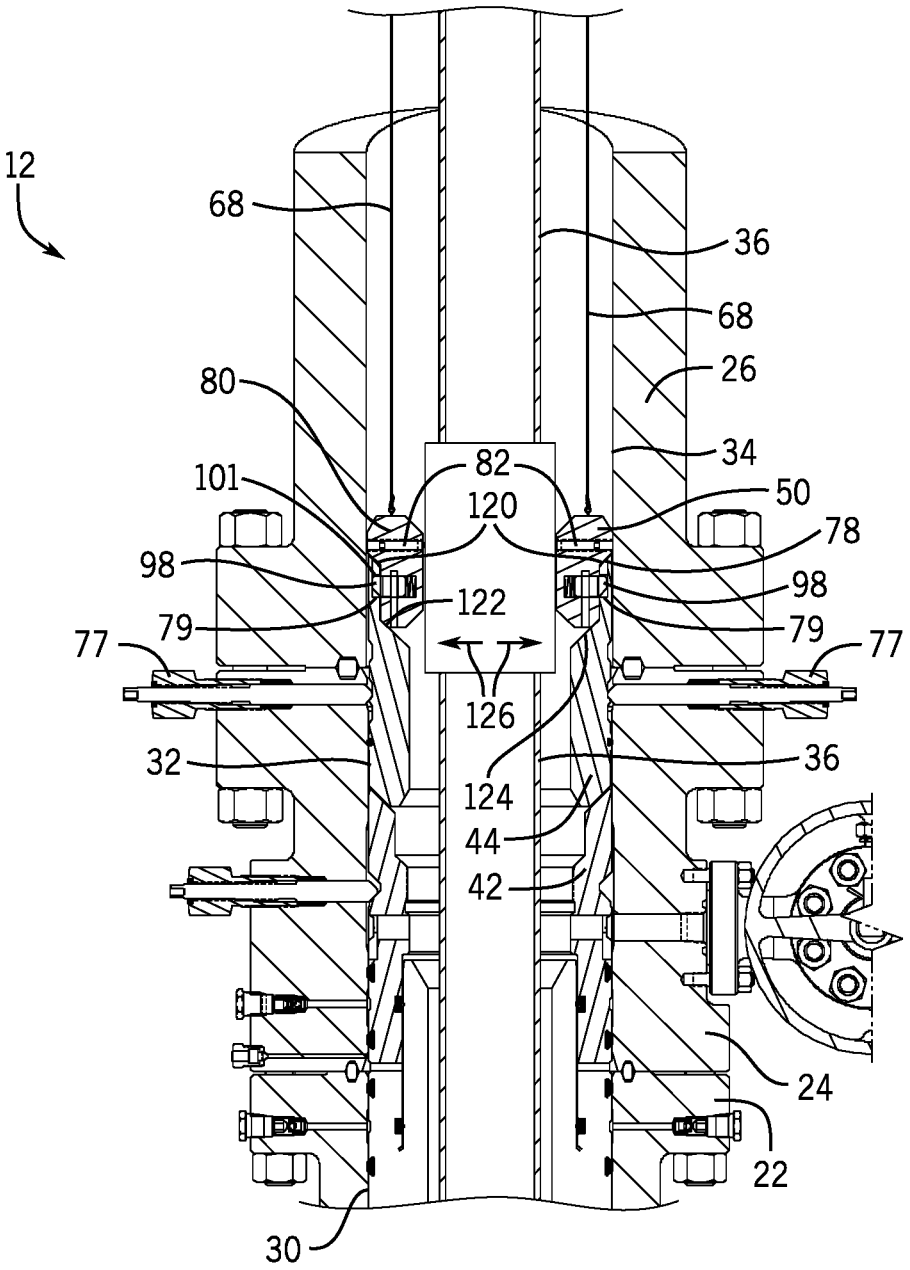
FIG. 4 is a cross-sectional side view of a wellhead assembly including a wear bushing retrieval tool landed against a wear bushing in the wellhead assembly, in accordance with an embodiment of the present disclosure.

FIG. 4 is a cross-sectional side view of an embodiment of the wellhead 12, illustrating the wear bushing retrieval tool 50 landed against the wear bushing 44 within the wellhead 12. In the illustrated embodiment, the wear bushing retrieval tool 50 is shown landed and engaged with the wear bushing 44 and still coupled to the collar 60 of the tubular string 36.

When the wear bushing retrieval tool 50 is landed against the wear bushing 44, a radially outward chamfered surface (e.g., downwardly facing chamfered surface) 120 of the main body 80 is landed against the chamfered surface or shoulder 78 of the wear bushing 44. Similarly, a radially inward chamfered surface (e.g., downwardly facing chamfered surface) 122 of the main body 80 is landed against a second chamfered surface 124 of the wear bushing 44, where the second chamfered surface 124 is axially below the chamfered surface 78. While the illustrated embodiment of the wear bushing retrieval tool 50 includes the radially outward chamfered surface 120 and the radially inward chamfered surface 122, other embodiments may include only one chamfered surface (e.g., radially outward chamfered surface 120 or the radially inward chamfered surface 122) configured to land against the wear bushing 44.

As discussed above, when the wear bushing retrieval tool 50 is landed against the wear bushing 44, the pins 98 are radially aligned with the annular recess 79 of the wear bushing 44. Thus, the springs 102 force the pins 98 radially outward, as indicated by arrows 126, such that the pins 98 are at least partially disposed within the annular recess 79 of the wear bushing 44. Thus, the pins 98 and the annular recess 79 radially overlap to enable axial engagement between the wear bushing retrieval tool 50 and the wear bushing 44 when the wear bushing retrieval tool 50 and the wear bushing 44 are retrieved from the wellhead 12.

Figure 5:
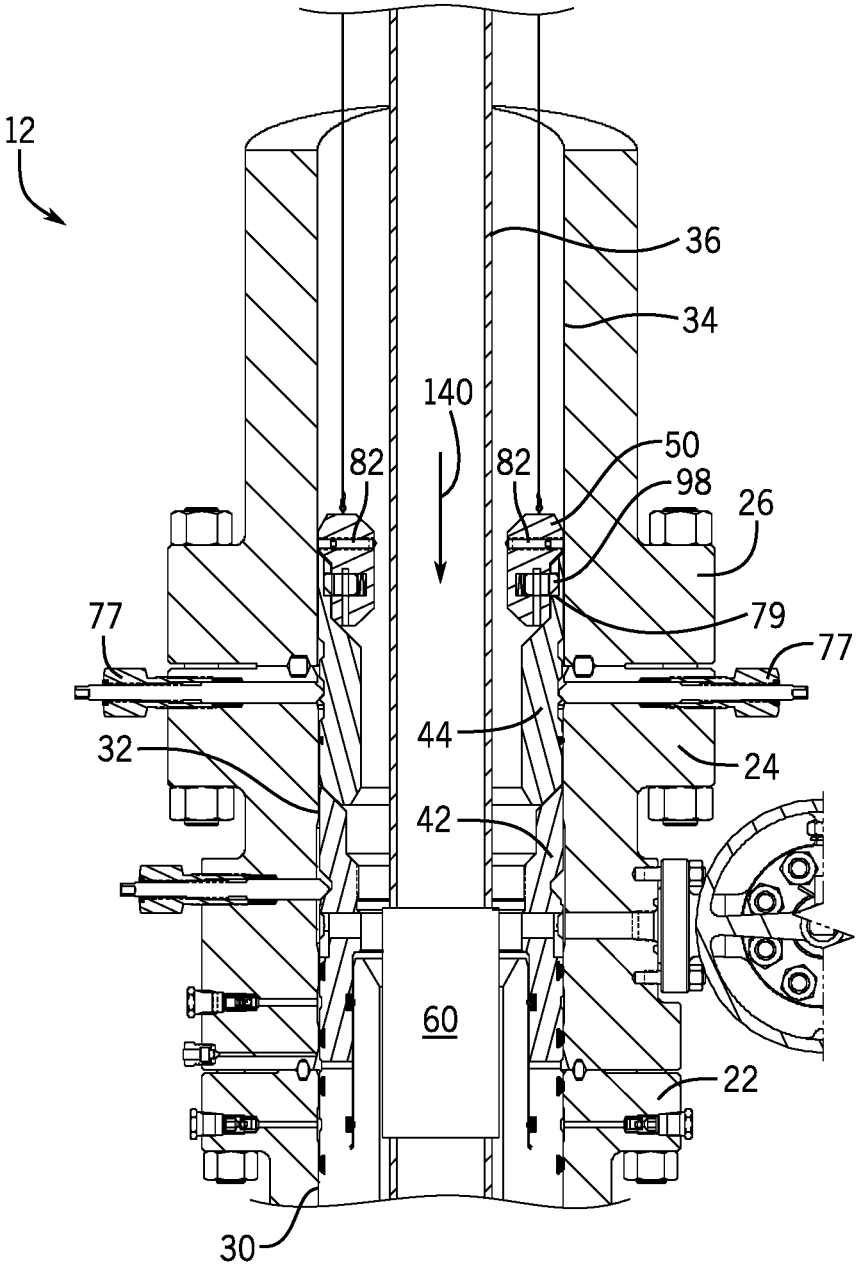
FIG. 5 is a cross-sectional side view of a wellhead assembly including a wear bushing retrieval tool landed against a wear bushing in the wellhead assembly with the wear bushing retrieval tool decoupled from the tubular string, in accordance with an embodiment of the present disclosure.

FIG. 5 is a cross-sectional side view of an embodiment of the wellhead 12, illustrating the tubular string 36 decoupled from the wear bushing retrieval tool 50 after the wear bushing retrieval tool 50 is landed against the wear bushing 44. As discussed above, the wear bushing retrieval tool 50 is coupled to the collar 60 (or other component of the tubular string 36) with the fasteners 82. In particular, the fasteners 82 are tightened within respective apertures 84 of the wear bushing retrieval tool 50 to create a frictional engagement between the wear bushing retrieval tool 50 and the collar 60. However, the frictional engagement between the wear bushing retrieval tool 50 and the collar 60 is not a permanent coupling. After the wear bushing retrieval tool 50 is landed against the wear bushing 44 within the wellhead 12 (e.g., via engagement between the radially outward chamfered surface 120 of the main body 80 and the chamfered surface or shoulder 78 of the wear bushing 44 and engagement between the radially inward chamfered surface 122 of the main body 80 and the second chamfered surface 124 of the wear bushing 44), further downward axial movement of the wear bushing retrieval tool 50 is blocked. However, running of the tubular string 36 through the wellhead 12 and into the wellbore 20 (e.g., by the handing equipment 38) may continue, as indicated by arrow 140. Indeed, the downward force applied to the tubular string 36 to run the tubular string 36 into the wellbore 20 may overcome the frictional force applied to the collar 60 by the fasteners 82 of the wear bushing retrieval tool 50. Thus, the tubular string 36 may continue to travel axially downward within the wellhead 12, and the collar 60 may become decoupled from the wear bushing retrieval tool 50, as shown.

Figure 6:
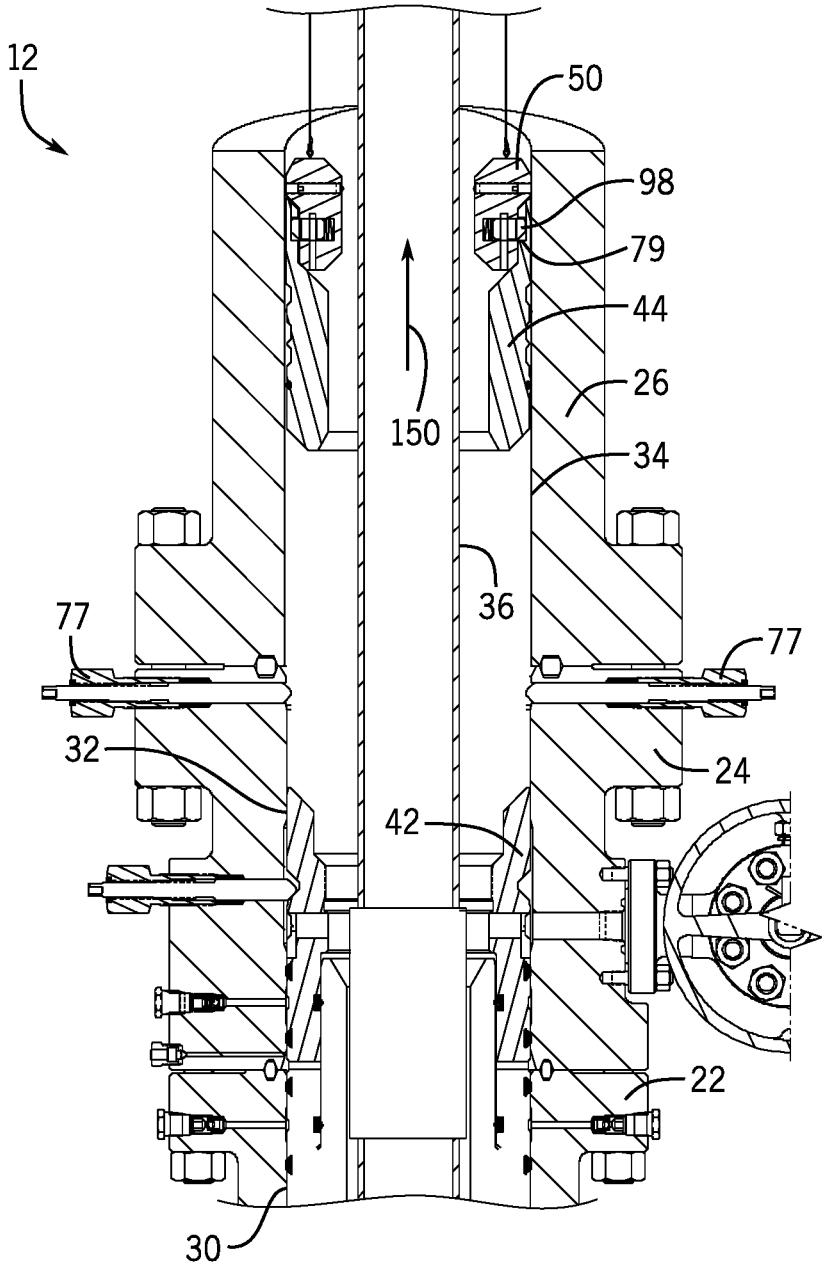
FIG. 6 is a cross-sectional side view of a wellhead assembly including a wear bushing retrieval tool retrieving a wear bushing from the wellhead assembly, in accordance with an embodiment of the present disclosure.
Figure 7:
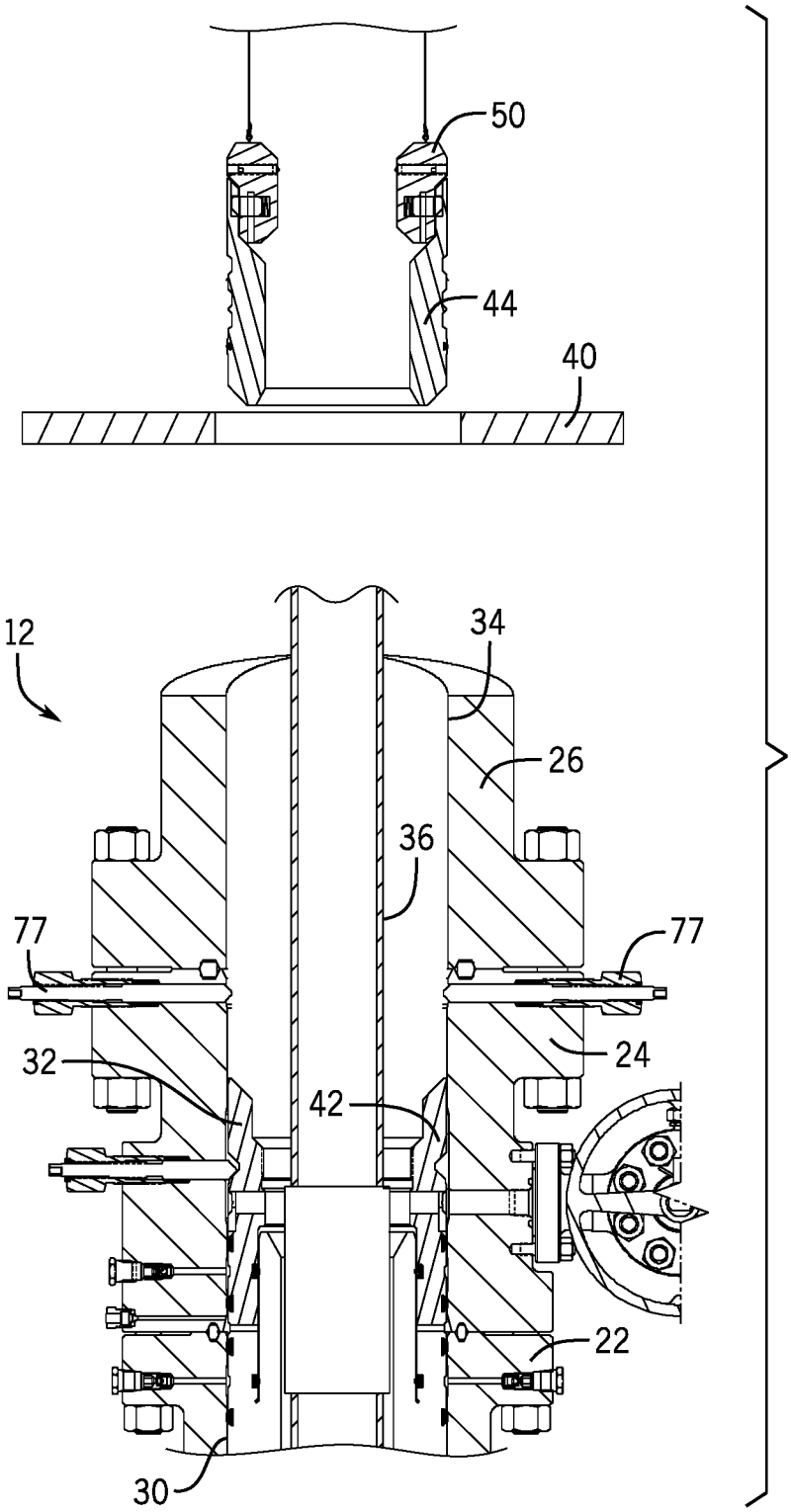
FIG. 7 is a cross-sectional side view of a wellhead assembly, illustrating a wear bushing retrieved from the wellhead assembly with a wear bushing retrieval tool, in accordance with an embodiment of the present disclosure.

After or as the tubular string 36 running process is completed, the wear bushing retrieval tool 50 and the wear bushing 44 may be retrieved from the wellhead 12. For example, FIG. 6 is a cross-sectional side view of an embodiment of the wellhead 12, illustrating retrieval of the wear bushing retrieval tool 50 and wear bushing 44 from the wellhead 12. As mentioned above, the wear bushing 44 is originally retained within the wellhead 12 by lock screws 77. When retrieval of the wear bushing retrieval tool 50 and the wear bushing 44 is desired, the lock screws 77 may be loosened to disengage from the wear bushing 44. With the lock screws 44 disengaged, the reeling equipment 76 may be actuated to draw in the cables 68. As discussed above, the reeling equipment 76 and roller assembly 74 work cooperatively to draw in the cables 68. As the cables 68 are reeled in, the wear bushing retrieval tool 50 and wear bushing 44 may be retrieved from the wellhead 12, as indicated by arrow 150 in FIG. 6. As described in detail above, engagement between the pins 98 of the wear bushing retrieval tool 50 and the annular recess 79 of the wear bushing 44 enable axial engagement between the wear bushing retrieval tool 50 and the wear bushing 44, which thereby enables retrieval of the wear bushing 44 with the wear bushing retrieval tool 50 as the cables 68 are reeled in by the reeling system 76 and roller assembly 74. FIG. 7 is a cross-sectional side view of an embodiment of the wellhead 12, illustrating the wear bushing retrieval tool 50 and wear bushing 44 fully retrieved from the wellhead 12. With the wear bushing 44 and the wear bushing retrieval tool 50 fully retrieved from the wellhead 12 above the rig floor 40, the wear bushing 44 may be decoupled from the wear bushing retrieval tool 50 for future use.

As described above, embodiments of the present disclosure are directed toward the wear bushing retrieval tool 50 for use in retrieving the wear bushing 44 installed in the wellhead 12. The wear bushing retrieval tool 50 may be installed over the tubular string 36 being run into the wellbore 20 through the wellhead 12. As discussed above, it may be desirable to install the wear bushing 44 within the wellhead 12 prior to running the tubular string 36 (e.g., casing string or tubing string) through the wellhead 12 into the wellbore 20 in order to protect components (e.g., a spool bore) of the wellhead 12 from undesired or unintended contact with the tubular string 36 as the tubular string 36 is run into the wellbore 20. As the tubular string 36 running operation nears completion, the wear bushing retrieval tool 50 is coupled to the tubular string 36 and is run into the wellhead 12 with the tubular string 36. In the manner described above, the wear bushing retrieval tool 50 is landed against the wear bushing 44 within the wellhead 12 and is subsequently decoupled from the tubing string 36. As or once the tubular string 36 running operation is completed, the wear bushing 44 may be released from the wellhead 12 and then retrieved from the wellhead with the wear bushing retrieval tool 50.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a wear bushing retrieval tool, comprising:

an annular main body having an outer diameter;

a pocket in the annular main body;

a radial coupling disposed in the pocket;

a radial actuator disposed in the pocket, wherein the radial actuator is configured to move radially along an axis to drive movement of the radial coupling radially along the axis to extend radially outward from the outer diameter of the annular main body, wherein the annular main body is configured to be disposed about a tubular string being run into a wellhead, the wear bushing retrieval tool is configured to frictionally engage with the tubular string to run the wear bushing retrieval tool to a wear bushing, the radial coupling is configured to engage with the wear bushing to enable retrieval of the wear bushing by the wear bushing retrieval tool, and the wear bushing retrieval tool is configured to frictionally disengage from the tubular string to allow the retrieval of the wear bushing.

2. The system of claim 1, wherein the wear bushing retrieval tool comprises:

a plurality of apertures extending from an inner diameter of the annular main body to the outer diameter of the annular main body;

a plurality of fasteners, wherein each of the plurality of fasteners is disposed within a respective one of the plurality of apertures; and wherein each of the plurality of fasteners is configured to removably engage with an outer diameter of the tubular string being run into the wellhead.

3. The system of claim 2, wherein each of the plurality of fasteners is threadingly engaged with the respective one of the plurality of apertures.

4. The system of claim 1, wherein the radial coupling comprises a plurality of radial pins, the pocket comprises a plurality of pockets, and each of the plurality of radial pins is disposed within a respective one of the plurality of pockets.

5. The system of claim 4, wherein the radial actuator comprises a plurality of radial actuators, and each of the plurality of pockets comprises one of the plurality of radial actuators.

6. The system of claim 1, wherein the radial actuator comprises a spring.

7. The system of claim 1, wherein the wear bushing retrieval tool is configured to be retrieved with the radial coupling engaged with the wear bushing and with the radial actuator in the pocket.

8. The system of claim 7, wherein the wear bushing retrieval tool comprises a fastener configured to frictionally engage with the tubular string to run the wear bushing retrieval tool to the wear bushing, and the system comprises a lift configured to retrieve the wear bushing retrieval tool separate from the tubular string.

9. The system of claim 1, comprising a plurality of cables, wherein each of the plurality of cables is coupled to the wear bushing retrieval tool.

10. The system of claim 9, comprising reeling equipment configured to reel in each of the plurality of cables to retrieve the wear bushing retrieval tool and the wear bushing from the wellhead.

11. A system, comprising:

a wear bushing retrieval tool comprising:

a main body configured to be disposed about a tubular string being run into a wellhead;

one or more fasteners coupled to the main body, wherein the one or more fasteners are configured to removably couple with the tubular string while running the wear bushing retrieval tool to a wear bushing; and a coupling driven by an actuator, wherein the actuator is configured to drive movement of the coupling toward a mating coupling of the wear bushing to provide a secured assembly of the wear bushing with the wear bushing retrieval tool;

wherein the secured assembly is configured to be retrieved separate from the tubular string, wherein the secured assembly comprises the actuator and the coupling as part of the wear bushing retrieval tool.

12. The system of claim 11, wherein the actuator is configured to move along an axis to drive movement of the coupling along the axis toward the mating coupling of the wear bushing.

13. The system of claim 11, comprising a lift configured to retrieve the wear bushing retrieval tool separate from the tubular string.

14. The system of claim 13, wherein the lift comprises a reeling system and a plurality of cables extending from the reeling system to the wear bushing retrieval tool, wherein the plurality of cables is coupled to a top surface of the main body, and the reeling system is configured to reel in the plurality of cables when the wear bushing retrieval tool is landed against the wear bushing.

15. The system of claim 11, wherein the actuator comprises a spring, and the spring and the coupling are configured to move radially along an axis.

16. A method, comprising:

running a wear bushing retrieval tool with a tubular string into a wellbore in a direction toward a wear bushing, wherein the wear bushing retrieval tool comprises an actuator and a coupling;

securing the wear bushing retrieval tool with the wear bushing by moving the actuator to drive the coupling to couple with a mating coupling of the wear bushing; and retrieving a secured assembly of the wear bushing with the wear bushing retrieval tool separate from the tubular string, wherein the secured assembly comprises the actuator and the coupling as part of the wear bushing retrieval tool.

17. The method of claim 16, wherein securing the wear bushing retrieval tool with the wear bushing comprises biasing the coupling in a radially outward direction with the actuator.

18. The method of claim 16, wherein securing the wear bushing retrieval tool with the wear bushing comprises moving the actuator along an axis to drive movement of the coupling along the axis toward the mating coupling of the wear bushing.

19. The method of claim 16, further comprising coupling the wear bushing retrieval tool to the tubular string with a frictional engagement between a plurality of fasteners extending radially inward from the wear bushing retrieval tool.

20. The method of claim 16, wherein retrieving the secured assembly comprises reeling in one or more cables coupled to the wear bushing retrieval tool of the secured assembly with a lift.

* * * * *